United States Patent [19]

Overman

[11] Patent Number: 4,463,088

[45] Date of Patent: Jul. 31, 1984

[54] SILVER HALIDE ANTIFOGGANTS BASED ON QUINOXALINE DERIVATIVES AND RELATED HETEROCYCLES

[75] Inventor: Joseph D. Overman, Wilmington, Del.

[73] Assignee: E. I. Du Pont de Nemours and Company, Wilmington, Del.

[21] Appl. No.: 511,018

[22] Filed: Jul. 5, 1983

[51] Int. Cl.[3] ..... G03C 1/34

[52] U.S. Cl. ..... 430/614; 430/615

[58] Field of Search ..... 430/614, 615, 600, 607, 430/613

[56] References Cited

U.S. PATENT DOCUMENTS 3,431,111 3/1969 Brooker et al. ..... 96/106

3,632,808 1/1972 Brooker et al. ..... 260/240.4

*Primary Examiner*—Won H. Louie, Jr.

[57] ABSTRACT

A group of heterocyclic antifoggants based on quinoxaline is useful in very high speed gelatino-silver halide emulsions.

2 Claims, No Drawings

SILVER HALIDE ANTIFOGGANTS BASED ON QUINOXALINE DERIVATIVES AND RELATED HETEROCYCLES

BACKGROUND OF THE INVENTION

1. Field of the Invention

This invention relates to very high speed silver halide emulsions and to photographic films prepared therefrom. More particularly, this invention relates to compounds which can be used in these emulsions to reduce fog associated therewith.

2. Description of the Prior Art

There is a pressing need to reduce silver halide coating weights in order to reduce the cost of the photographic film produced therefrom. One way to accomplish this reduction is to increase the sensitivity of the emulsion in order to raise the speed of the film, and, simultaneously to reduce the size of the silver halide grain and thus increase the covering power of said film. The problem with this is that the addition of either extra sensitizing agent or the addition of new and more powerful sensitizers invites an increase of fog. While there is a veritable host of antifogging compounds in the prior art which are useful in conventional silver halide systems, there is still need to develop new and more powerful antifogging agents to overcome the problem noted above.

Therefore, it is an object of this invention to provide new, powerful antifoggants particularly useful in high speed, low coating-weight silver halide photographic film.

SUMMARY OF THE INVENTION

This and other objects are achieved by providing a photographic film comprising a support, and a silver halide emulsion coated thereon, characterized in that said emulsion contains an antifogging amount of a quinoxaline derivative having one of the formulas (a)

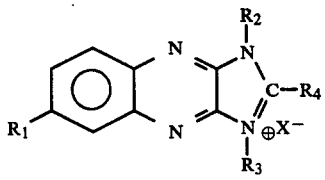

where $R_1$=H or $NO_2$, $R_2$ and $R_3$=H, alkyl, or alkene, $R_4$=alkyl, and X— is an anion;

(b)

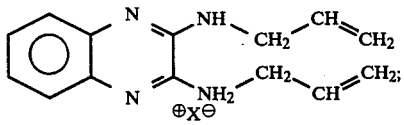

(c)

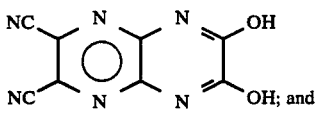

-continued (d)

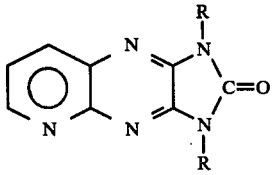

where R is alkyl. Emulsions prepared with these very effective antifogging agents can be highly sensitized and coated at much lower coating weight than conventional, prior art elements.

The fog of these emulsions is very low, yet there is very little speed loss of or tradeoff from the use of these antifogging agents. This is very surprising since it is well known that antifogging agents generally desensitize the emulsion somewhat in addition to reducing the fog.

DETAILED DESCRIPTION OF THE INVENTION

The antifogging compounds of this invention and, in the case of (a), above, the salts thereof, are dissolved in a suitable solvent and added to the emulsion, preferably after it has been fully sensitized and just prior to coating said emulsion on a suitable support. Preferably, solvents miscible with water are used, since they are more compatible with gelatino-silver halide emulsions. These compounds are generally added in amounts ranging from 0.005 g to 5 g, preferably 0.025 to 0.200 g, per 1.5 moles of silver halide, the conventional "unit of emulsion".

Any of the commonly used gelatino-silver halide emulsions can be used in the practice of this invention, e.g., silver bromide, silver chloride, silver iodide or mixed halides. The emulsions may be sensitized with sulfur, gold, or polyethylene oxide, for example, along with other commonly used sensitizers. A particular group of effective sensitizers are the derivatives of application Ser. No. 363,378, filed Mar. 29, 1982, in particular, 2-(4-methoxyphenyl)-thiazolidine and cysteamine. When these sensitizers are used as taught in this reference, the speed of an X-ray emulsion, for example, can be increased up to 40%. Thus, it is possible to prepare a photographic film of equivalent sensitivity using lower silver halide coating weights.

The emulsions of this invention may also contain wetting agents, hardeners, other antifoggants, dyes and other common adjuvants well known to thoese skilled in the art. Commonly used binders (e.g., gelatin, PVA, etc.) may also be efficaciously used in the making of these emulsions.

The emulsions of this invention may be coated on any of the commonly used film supports such as polyethylene terephthalate, cellulosic films, etc. The preferred support is dimensionally stable polyethylene terephthalate film suitably "subbed" (subcoated) as described in the prior art.

This invention is illustrated by the following Examples of which Example 1 is considered the best mode:

EXAMPLE 1

A coarse-grained gelatino-silver iodobromide emulsion of the type used in medical X-ray films was prepared, specifically an emulsion containing ca. 98 mole % AgBr and ca. 2 mole % AgI with about 5 weight % of gelatin and about 10 weight % of silver halide. The emulsion was fully sensitized by digestion at elevated temperatures with thionex and gold thiocyanate. After digestion, the usual wetting agents, coating aids, and antifoggants were added and the emulsion split into five portions. One portion was coated without further treatment (Control I). One portion was further sensitized by the addition of 0.012 g cysteamine hydrochloride/unit of emulsion and then coated (Control II). The other portions were also sensitized with 0.012 g cysteamine .HCl and various antifoggants of this invention were added in the amounts shown dissolved in alcohol.

All five emulsion samples were coated on clear 0.007 inch (0.018 cm) thick biaxially oriented and heat-relaxed polyethylene terephthalate film supports. The film supports had been subbed on each side with a conventional resin subbing layer (e.g., a vinylidene chloride/methyl acrylate/itaconic acid copolymer mixed with a methyl acrylate polymer) over which a thin anchoring substratum of hardened gelatin had been coated (about 0.5 mg/dm$^2$). The emulsion was applied on one side of the film support at a coating weight of about 50 mg/dm$^2$ of silver bromide and a 10 mg/dm$^2$ abrasion layer of hardened gelatin was applied thereon.

Sample strips from each coating were then exposed through a $\sqrt{2}$ step wedge for $10^{-2}$ seconds on a Mark 7 Sensitometer produced by E. G. and G. Co. (GE Type FT-118 Xenon Flash Tube) containing a 2.0 neutral density filter and a No. 207763, $10^{-2}$ compensating attenuating grid. The exposed strips were then developed for 3 minutes at room temperature in a standard X-ray type developer (phenidone/hydroquinone), fixed, and dried. The following results were obtained:

| Sample | Rel. Speed | Gamma | Fog |
|---|---|---|---|
| I Control - with no cysteamine | 100 | 0.9 | 0.03 |
| II Control + cysteamine | 187 | 0.8 | 0.06 |
| III with Antifoggant A, 1.12 g/unit | 187 | 0.8 | 0.04 |
| IV with Antifoggant B, 1.5 g/unit | 200 | 0.8 | 0.05 |
| V with Antifoggant C, 0.125 g/unit | 132 | 1.1 | 0.01 |

-continued

| Sample | Rel. Speed | Gamma | Fog |
|---|---|---|---|

Antifoggant A

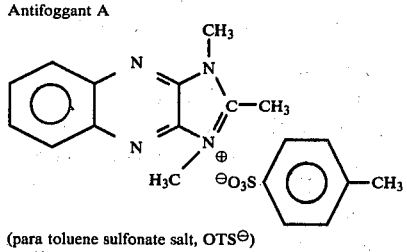

(para toluene sulfonate salt, OTS$^{\ominus}$)

Antifoggant B

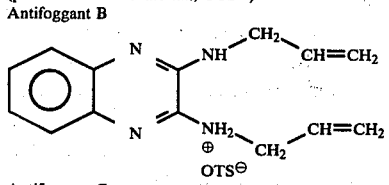

Antifoggant C

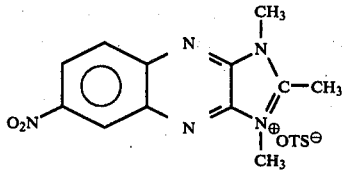

The antifoggants of this invention permitted the use of an additional, more powerful sensitizer (e.g., cysteamine) in order to gain more emulsion speed while holding down the fog.

EXAMPLE 2

In this example, the emulsion of Example 1 was used and, after digestion with conventional sensitizers and the addition of wetting agents, coating aids and normal antifoggants, was split into seven portions. One portion was coated without further treatment (Control I) and the second portion was coated after sensitizing further with 0.013 g/unit of cysteamine. The remaining five portions were all sensitized with the same amount of cysteamine and, in addition, antifoggants of this invention-dissolved in alcohol-were added as shown below. The emulsions were coated, sampled, exposed and developed as described in Example 1 with the following results:

| Sample | Rel. Speed | Gamma | Fog |
|---|---|---|---|
| I Control - no cysteamine | 100 | 1.2 | 0.03 |
| II Control + cysteamine | 304 | 0.9 | 0.11 |
| III with 0.05 g/u Antifoggant A, | 215 | 0.8 | 0.05 |
| IV with 0.075 g/unit Antifoggant C | 187 | 1.0 | 0.04 |
| V with 0.1 g/unit Antifoggant C | 187 | 1.1 | 0.03 |
| VI with 0.15 g/unit Antifoggant D(1) | 162 | 0.9 | 0.03 |
| VII with 0.225 g/unit Antifoggant D(1) | 141 | 0.8 | 0.02 |

(1)Antifoggant D -

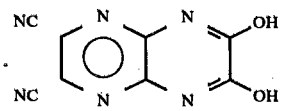

EXAMPLE 3

In this example, the emulsion of Example 1 was used and, after digestion with conventional sensitizers and the addition of wetting agents, coating aids, and normal antifoggants, was split into four portions. One portion was coated without further treatment (Control I) and the second portion was coated after sensitization with 0.048 g/unit of cysteine hydrochloride, another very powerful sensitizer. The remaining two portions were also sensitized with the same amount of cysteine hydrochloride and, in addition, Antifoggant C of this invention as added in the amounts shown. The emulsions were coated, sampled, exposed and developed as described in Example 1 with the following results:

| Sample | Rel. Speed | Gamma | Fog |
|---|---|---|---|
| I Control - no cysteine.HCl | 100 | 0.9 | 0.01 |
| II Control with cysteine.HCl | 162 | 0.8 | 0.05 |
| III with 0.05 g/unit Antifoggant C | 142 | 1.0 | 0.01 |
| IV with 0.1 g/unit Antifoggant C | 108 | 0.9 | 0.01 |

I claim:

1. A photographic film comprising a support, and a silver halide emulsion coated thereon, characterized in that said emulsion contains an antifogging amount of a quinoxaline derivative having one of the formulas (a)

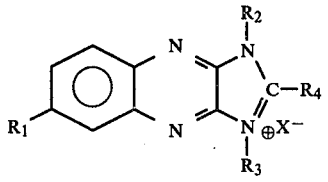

where $R_1$=H or $NO_2$, $R_2$ and $R_3$=H, alkyl, or alkene, $R_4$=alkyl, and X— is an anion;

(b)

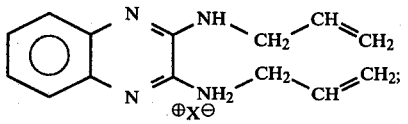

(c)

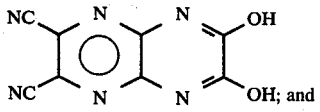

(d)

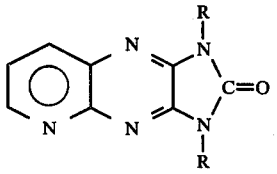

where R is alkyl.

2. The photographic film of claim 1 wherein said quinoxaline derivative is present in an amount of 0.005 g to 5 g per 1.5 moles silver halide.

* * * * *